United States Patent [19]

Dabbs et al.

[11] Patent Number: 5,058,566

[45] Date of Patent: Oct. 22, 1991

[54] FIREPLACE HEARTH PAD SYSTEM

[76] Inventors: Stephen L. Dabbs, 916 Elderberry; Clay B. Bowen, Rte. 7, Box 66-S, both of Tupelo, Miss. 38801

[21] Appl. No.: 650,601

[22] Filed: Feb. 5, 1991

[51] Int. Cl.[5] ..... F24B 1/18

[52] U.S. Cl. ..... 126/500; 52/288

[58] Field of Search ..... 126/500; 52/288

[56] References Cited

U.S. PATENT DOCUMENTS 4,903,686 2/1990 Jennings ..... 126/500

*Primary Examiner*—Carroll B. Dority

*Attorney, Agent, or Firm*—Richard C. Litman

[57] ABSTRACT

An easily attachable system is provided to pad the edges of a fireplace hearth with the primary purpose of reducing the risk to children of concussive or abrasive injury from the sharp edges and of the hearth. The system is defined by a rigid frame which readily attaches with no damage to the hearth itself but which can not easily be removed by children. The rigid frame is overlaid with a readily attachable protective padding made of, or coated with, an appropriate fire retardant material. In a second embodiment of the invention, a unitary system is provided wherein the frame itself is constructed of appropriate flame retardant padded material which provides the desired protection against injury. The system readily attaches in a non-destructive fashion to any size fireplace hearth and compensates for dimensional irregularities in the hearth itself. In addition to providing protection against concussive injury, the hearth pad of the invention provides fire prevention benefit by presenting an additional barrier to sparks and flaming embers escaping from the fireplace and igniting furniture or rugs.

15 Claims, 2 Drawing Sheets

FIREPLACE HEARTH PAD SYSTEM

FIELD OF THE INVENTION

This invention relates to a protective padding system to enclose the exposed edges and corners of a raised fireplace hearth.

BACKGROUND OF THE INVENTION

The residential use of fireplaces with raised hearths has gained widespread popularity. However, such raised hearths can pose safety hazards to the residents, especially small children. The exposed edges and corners of the hearth, generally constructed of stone, brick, or other hard material, pose a danger of concussive injury to persons falling against or otherwise contacting an edge or corner. Further, children can also suffer cuts or abrasions by simply contacting the roughened surface of said hearth edges or corners. Therefore, the invention provides a system for enclosing the edges and corners of raised fireplace hearths with protective padding. The hearth pad of the invention also provides fire prevention benefit by presenting an additional barrier to sparks and flaming embers escaping from the fireplace and possibly igniting furniture or rugs.

It is known to provide padding for fireplace hearths. However, the prior art systems are either unsecured or can only be secured in a destructive manner. The unsecured padding systems carry the high probability of the padding becoming detached from the heart corners and edges, especially in the presence of small children, and will, therefore, it can be expected, cease to offer the intended protection as well as creating other safety and aesthetic disadvantages, the prior art securable padding systems are only securable to the hearth by the use of adhesive, or by screws or bolts driven into holes drilled directly into the hearth material or adjoining environmental surfaces.

Therefore, it would be advantageous to develop a system for securely attaching padding to the exposed corners and edges of a fireplace hearth without damaging or otherwise altering the hearth or adjoining environmental surfaces.

DESCRIPTION OF THE RELATED ART

U.S. Pat. No. 4,922,891 shows a fireplace hearth pad to provide concussive and abrasive protection for the corners and edges of a fireplace hearth. However, the pad shown is either unsecured or, if it is desired to secure it to the hearth, must be attached to the hearth material by adhesive.

U.S. Pat. No. 4,903,686 shows a fireplace hearth pad to provide protection from injuries for the corners and edges of a fireplace hearth. However, the padding shown can either be unsecured, or if secured, must be attached to the hearth material by adhesive or by a dowel and hook arrangement wherein the dowels are mounted in holes drilled directly into the hearth material.

U.S. Pat. No. 505,577 shows a protective frame attachable to a fireplace hearth. However, the device can only be secured by bolts or screws driven into the floor surrounding the hearth.

None of the above disclosures are seen as suggesting the unique combination as presented by the instant invention which provides a padding system that offers reduced risk or concussive or abrasive injury from the exposed corners and edges of raised fireplace hearths, and that can be securely attached without damaging or otherwise altering the hearth material or adjoining environmental surfaces.

SUMMARY OF THE INVENTION

By the present invention there is provided an improved apparatus for padding the exposed corners and edges of a raised fireplace hearth to reduce the risk or injury especially to small children by contact with the sharp exposed edges and corners of the hearth. The apparatus also provides a fire prevention benefit by presenting an additional barrier to sparks and flaming members escaping from the fireplace. The apparatus securely attaches to varying size fireplace hearths, and compensates for dimensional irregularities in the hearths, without damaging the hearth material or any other environmental surface.

In one embodiment, the apparatus consists of a frame to which is attached the overlying padding material. The frame consists of two corner members which enclose the exposed edges at each outer corner of the fireplace hearth and a front member which encloses the front edge of the fireplace hearth and has end plates which overlie the corner members. The end plates of the front member of the invention are provided with tensioning means by which, once the front member is in proper position, tension may be applied through the end plates against the corner members beneath. Sufficient tension is applied to urge the frame into to a tight clamping relation with the fireplace hearth without any damage to the hearth material itself.

The front member may be comprised of two telescoping segments each with a series of screw holes or the like so that the front member may be adjusted to fit fireplace hearths of varying widths. When the proper width is achieved, the telescoping segments can be secured to each other. Alternatively, when the proper width is achieved, the two segments of the front member may be connectably attached by an overlying a separate central connecting segment.

When the frame is in place, it is then overlaid with the padding material. The padding material is constructed to provide protection against concussive and abrasive injury and flame retardation. In this embodiment, the padding material, if worn or damaged or for aesthetic reasons, may be removed and replaced without disturbing the underlying frame. The padding material may also be foldably attached to the underside of the frame so that it may not readily be removed by children.

In a second embodiment of the invention, the frame itself is constructed of a molded material providing the requisite padding against concussive or abrasive injury and flame retardation without the necessity for separate overlying padding material. In this embodiment, the corner members and the front member are an integral unit. Therefore, the tensioning means is applied through the corner members directly to the underlying hearth material but without damage to the hearth material. Also in this embodiment of the invention, the apparatus may consist of telescoping segments or, alternatively, two segments underlying a central connecting segment, attachable when the proper length is achieved.

Accordingly, one of the objects of the present invention is to provide an improved apparatus for padding the exposed edges and corners of a raised fireplace hearth which provides reduced risk of concussive or abrasive injury, and flame retardation, and which securely fastens to the hearth with no damage or alteration of the hearth material.

Another object of the present invention is to provide an improved apparatus for padding the exposed edges and corners of a raised fireplace hearth which securely fastens by tensioning means to the hearth with no damage or alteration of the hearth material, which is adjustable to fit fireplace hearths of varying widths, and which will compensate fore fireplace hearths having structural irregularities.

A further object of the present invention is to provide an improved apparatus for padding the exposed edges and corners of a raised fireplace hearth which consists of an underlying frame assembly and of overlying padding with means for quick fastening and release of the padding from the frame assembly so that the padding may readily be replaced if damaged, soiled, or for aesthetic reasons.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figures 1, 1A:
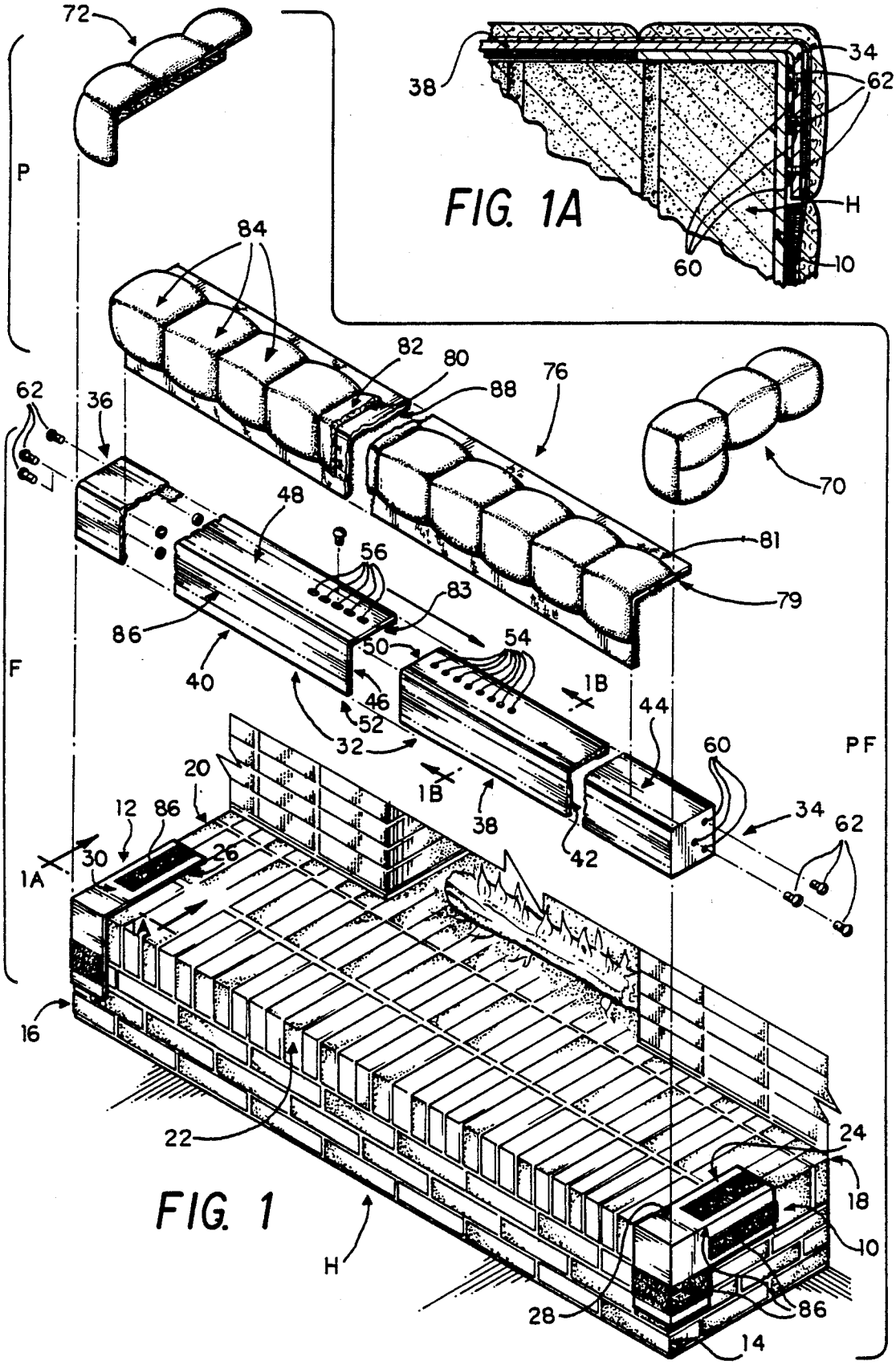
FIG. 1 is an exploded perspective view of the frame and padding material of the padded frame assembly of the first embodiment of the invention as mounted on a raised fireplace hearth.
FIG. 1A is a sectional view of the frame assembly of the first embodiment of the invention taken along line 1A—1A of FIG. 1.

Referring now to FIG. 1 of the drawings is shown the padded frame assembly PF of the first embodiment of the invention comprising the frame assembly F and the overlying padding P. The frame assembly F can be constructed of any suitable, substantially rigid material. However, appropriate gauge sheet metal is preferred. Corner members 10 and 12 of the frame assembly F of the invention are unitary structures with vertical and horizontal right angled walls and opposing inner, 24 and 26, and outer, 28 and 30, surfaces with the inner surfaces to enclose the front vertical edges 14 and 16 and the receding top edges 18 and 20 at the exposed corners of the fireplace hearth H. The corner members 10 and 12 can be dimensioned as desired to be attachable to a range of fireplace hearth depths and heights, but must not exceed the depth and height of the fireplace hearth on which they are to be used.

The front member assembly 32 of the frame assembly F is a rigid structure having horizontal and vertical right angled walls and perpendicular end plates 34 and 36. The front member assembly 32 may be a unitary structure dimensioned to fit a single fireplace hearth of given width. However, the preferred configuration of the front member assembly 32 is segmented into a right front segment 38, with horizontal and vertical walls defining opposed inner 42, and outer 44 surfaces and with an outer edge defined by the end plate 36 and an inner edge 50, and a left front segment 40 having horizontal and vertical walls defining opposed inner 46, and outer 48 surfaces and having an outer edge defined by end plate 34 and an inner edge 52. The two segments 38 and 40 are designed to be telescoping, that is the inner surface 46 of the left front segment 40 will juxtapose a portion of the outer surface 44 of the right front segment 38.

Attachment means are provided to secure the left front segment 38 to the right front segment 40. In the preferred embodiment, are provided a series of openings 54, passing from the outer surface 44 to the inner surface 42 of the right front segment 38. In a linear arrangement beginning adjacent to the inner edge 50, and a series of openings 56, passing from the outer surface 48 to the inner surface 46 of the left front segment 40, in a linear arrangement beginning adjacent to the inner edge 52 of the left front segment 40.

Figure 1B:
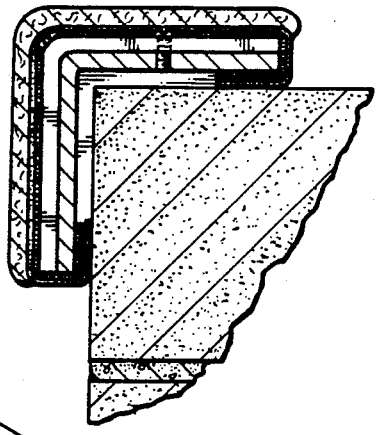
FIG. 1B is a sectional view of the frame assembly of the first embodiment of the invention taken along line 1B—1B of FIG. 1.

In operation, once the front member assembly 32 is in approximately the proper position with inner surfaces 42 and 46 juxtaposing the exposed front edge 22 of the fireplace hearth H and the outer surfaces 28 and 30 of the corner members 10 and 12, the assembly is further adjusted so that the openings 56 in the left front member 40 are in alignment with the underlying openings 54 in the right front segment 38. Fastening means, preferably screw thread fasteners, are now passed through openings 56 and through the underlying matching openings 54 as shown in detail in the assembled position in FIG. 1B.

As shown in FIG. 1, the end plates 34 and 36 are provided with openings 60 passing from the outer surfaces 44 and 48 to the inner surfaces 42 and 46 of the right 38 and left 40 front segments respectively. Tensioning means, preferably screw thread members 62, are applied through openings 60 against the outer surfaces 28 and 30 of the corner members 10 and 12 respectively. This is shown in greater detail in FIG. 1A for corner member 10 and front segment 38 with end plate 34 in their final assembled position on the fireplace hearth. (A similar view taken at end plate 36 would, of course, be a mirror image.) Sufficient tension is thus created to urge the corner members 10 and 12 and the front member assembly 32 into a secure gripping relationship with the fireplace hearth H. The number of openings 60 may vary but must be at least three, as shown, in the preferred embodiment. In this manner, unevenness in the structure of the fireplace hearth H can be compensated for by individually varying the degree of extension of the screw thread members 62 beyond the openings 60.

Referring again to FIG. 1 is shown the padding P of the invention. The padding material P is configured into padding end units 70 and 72 which attach to the frame assembly F overlying the end plates 34 and 36 of the front member assembly 32 and the corner members 10 and 12, and a padding front unit 76 which attaches to the frame assembly F to overlie the front member assembly 32.

The padding P of the invention is pre-constructed, as shown at the cutaway, of a relatively stiff backing material 78 overlaid with padding material, preferably a fire retardant foam 80 covered with a layer 82 of fire retardant material, or material with a fire retardant coating. The covering layer 82 is selected for reduced risk of abrasive injury and from a variety of available aesthetically desirable finishes and colors. As can be seen, the padding is constructed of attached segments 84. Therefore, when the frame assembly F is configured and secured to a fireplace hearth H of given width, the padding can be readily sized to fit the frame assembly F by detaching excess segments 80, preferably by cutting. Preferably, the padding front unit 76 is cut to cover somewhat less than the complete length of the front member assembly 32, allowing space at either end for the padding end units 70 and 72 which are subsequently attached to the frame assembly F to cover the front member end plates 34 and 36, and the underlying corner members 10 and 12, and which abut the padding front unit at its ends.

The padding P is readily attachable to the frame assembly F by any expeditious and secure fastening means, preferably hook-and-loop pile fasteners. Hook-and-loop pile fastening strips 88 are, therefore, provided on the underside of the padding P to attach to the fastening strips 86 on the frame assembly F, for both the front member and the underlying corner members.

Because of the expeditiousness with which the padding P may be attached to the frame assembly F, it is a small task to remove and replace the padding P should the padding P become damaged, soiled, or for aesthetic reasons.

It will be readily apparent that the padding P may alternatively be attached to the frame assembly F, before the frame assembly F is finally installed and secured on the fireplace hearth H. In following this procedure, the front assembly 32 is adjusted to fit the given fireplace hearth width and the right front segment 38 and left front segment 40 of the front assembly 32 are secured to each other by attachment means passing through openings 56 and 54, then the front assembly 32 is displaced from the fireplace hearth. The padding P is now attached to the frame assembly F corner members 10 and 12 and front member assembly 32, and finally the complete frame assembly F with attached padding P installed on the fireplace hearth H following the procedure described above. To follow this procedure, the backing material layer 78 of the padding may be tucked under various edges of the frame assembly F so that when the frame assembly F is secured into a tight gripping relationship with the hearth H, the padding P is further secured. Hook-and-loop pile fastening strips 79 are, therefore, provided on extended flaps 81 of the backing layer 78 and a fastening strip 83 provided on the inner surface 46 of the front member assembly.

Figure 2:
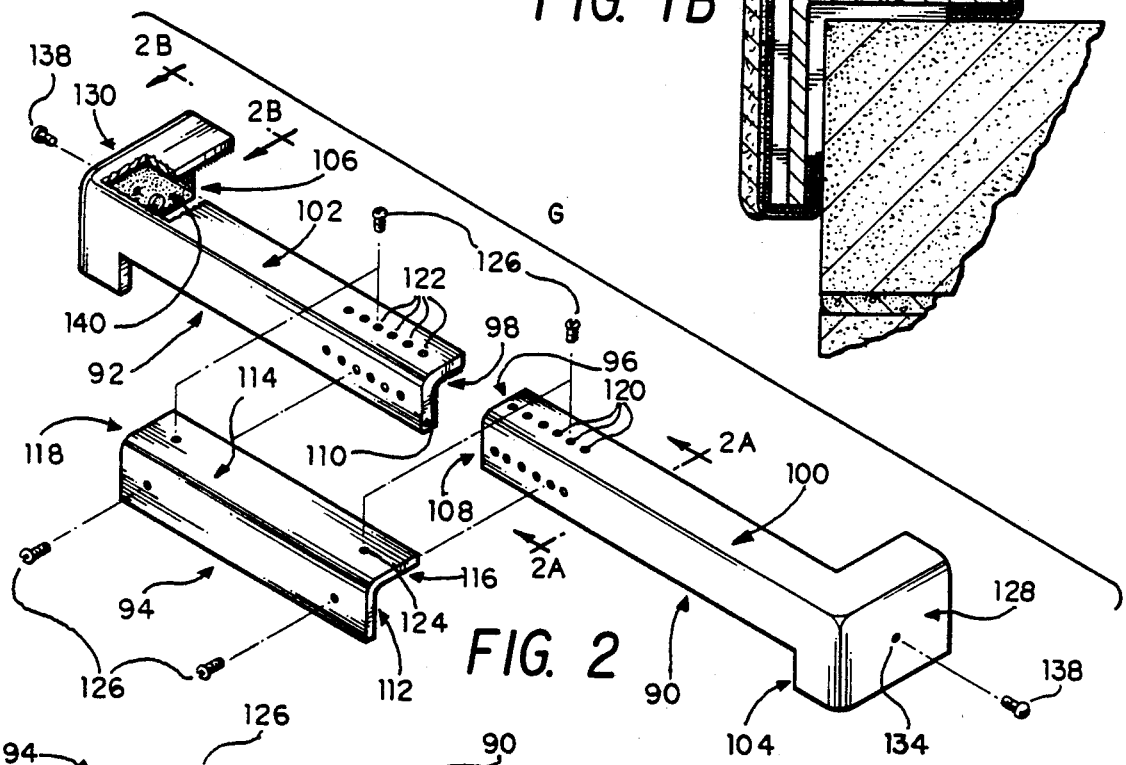
FIG. 2 is an exploded perspective view of the second embodiment of the invention.

Referring to FIG. 2 is shown the second embodiment of the invention. In this embodiment, the padded frame assembly G of the invention is constructed of a substantially rigid molded fire retardant, or fire retardant coated, materials with outer surface selected for reduced risk of abrasive injury, and for aesthetic appearance and color. Further, the padded frame assembly G of the invention is constructed of materials and in a manner to provide reduced risk of concussive injury so that in this embodiment of the invention, no additional padding is required to meet the objectives of the invention.

The padded frame assembly G consist of three members, end members 90 and 92 and center member 94. Because of the increased ease of fabrication of the structural elements of this embodiment and because of reduced weight, it has been found that separate members analogous to the corner members 10 and 12 of the first embodiment as shown in FIG. 1 are unnecessary, the end members 90 and 92 incorporating the function of the corner members in a unitary structure. Of course, it is apparent that a similar configuration for the first embodiment is also within the scope of the invention.

End members 90 and 92 are configured with vertical and horizontal walls defining inner surfaces 96 and 98, and outer surfaces 100 and 102 respectively and with outer edges 104 and 106 and inner edges 108 and 110 respectively. The center member 94 is configured with vertical and horizontal walls defining an inner surface 112 and outer surface 114 and edges 116 and 118. End members 90 and 92 are provided with a series of openings 120 and 122 extending from outer surfaces 100 and 102 to inner surfaces 96 and 98. The openings 120 and 122 arranged in a linear relationship extending from edges 108 and 110 respectively. Center member 94 is provided with a plurality of openings 124, preferably four, adjacent to edges 116 and 118 and extending from outer surface 114 to inner surface 112.

The end members 90 and 92 are juxtaposed to fireplace hearth H exposed front vertical edges 14 and 16, as shown in FIG. 1, and the exposed receding upper horizontal edges 18 and 20 and a portion of the fireplace hearth H exposed upper front horizontal edge 22 with the end members, shown in FIG. 2, from outer edges 104 and 106 to inner edges 108 and 110 extending, as shown in FIG. 1, from the intersections of edges 16 and 20, and 148 and 18, respectively. The center member 94, shown in FIG. 2, juxtaposes the remaining portion of fireplace front horizontal edge 22, shown in FIG. 1, not covered by end units 90 and 92. The end members 90 and 92 overlie the center member 94 with the inner edges 96 and 98 of the end members 90 and 92, respectively, extending beyond the edges 116 and 118 of the center member 94.

Figure 2A:
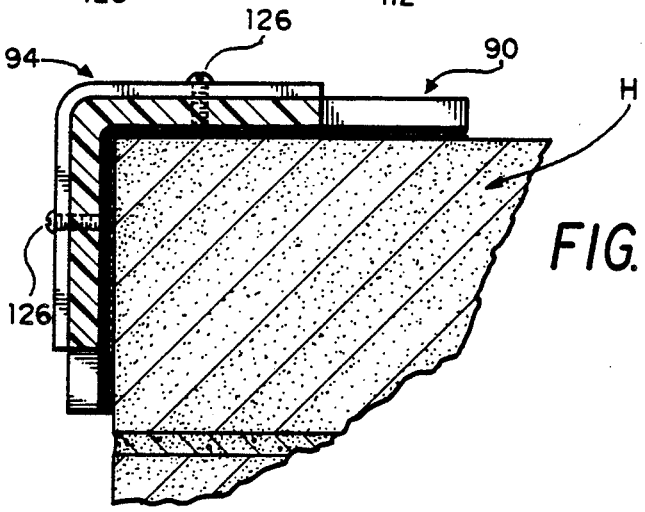
FIG. 2A is a sectional view of the second embodiment of the invention taken along line 2A—2A of FIG. 2.

To install the padded frame assembly G, center member 94 is placed to enclose fireplace hearth H horizontal upper front edge 22, shown in FIG. 1. The end members 90 and 92 are placed in enclosing relationship to the exposed fireplace hearth edges and to the center member 94 as described above and as shown in FIG. 2. Attachment means, preferably screw thread fasteners 126, are then passed through those of the openings 120 and 122 in end members 90 and 92 respectively, now in matched relationship to the underlying openings 124 in center member 114. This is shown in detail in the assembled position in FIG. 2A. In this manner, the padded frame assembly G of the invention can be installed on a range of fireplace hearth widths.

Figure 2B:
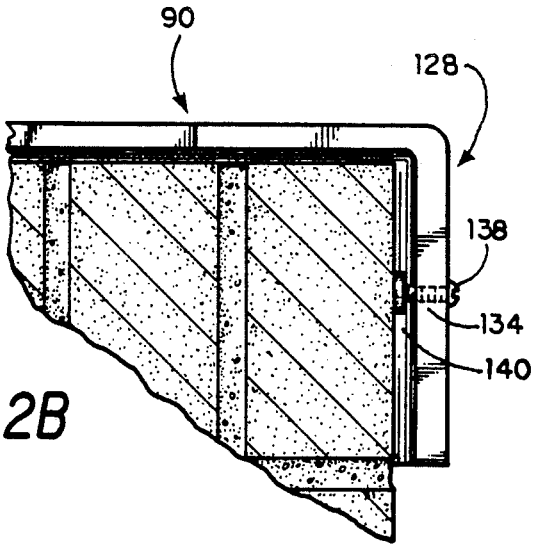
FIG. 2B is a sectional view of the second embodiment of the invention taken along line 2B—2B of FIG. 2.

As shown in FIG. 2 and in greater detail in FIG. 2B (showing end portion 128 of end member 90 as assembled on the fireplace hearth; a similar view taken at end portion 120 would, of course, be a mirror image), the end plate portions 128 and 130 of the integral end members 90 and 92 respectively, are juxtaposed to the vertical side walls of the fireplace hearth H, as defined by fireplace hearth edges 16 and 20, and 14 and 18 respectively, shown in FIG. 1. The integral end members 90 and 92 are provided with tensioning means, preferably threaded openings 134 and 136 through which are inserted threaded tension members 138. In this embodiment of the invention, the tension members 138 directly contact the hearth. Therefore, as shown in FIG. 2B, the ends of the tension members 138 may be provided with pivoting contact plates 140 as shown or with padding, to further ensure that there is no damage to the underlying hearth material.

When the padded frame assembly G, therefore, is in the proper position on the fireplace hearth, sufficient tension is applied through the tension members 138 to urge the padded frame assembly G into tight clamping relationship to the fireplace hearth H.

Although substantially rigid, the padded frame assembly G, by virtue of the preferred materials and mode of construction, is expected to have a somewhat greater degree of flexibility and to be more lightweight than the frame assembly F of the first embodiment of the invention. Therefore, it is preferred to provide a single tension members 138 for each end plate portion 126 and 128 as the padded frame assembly G, it is contemplated, will have sufficient flexibility to accommodate dimensional irregularities in fireplace hearth construction. Of course, it is readily apparent that multiple tension members 138 for each end plate portion 126 and 128 may also be employed.

It is to be understood that the present invention is not limited to the sole embodiments described above, but encompasses any and all embodiments within the scope of the following claims.

What is claimed is:

1. A padding system for the peripheral edges and corners of a raised fireplace hearth having a top surface bounded by front and opposite side walls, comprising:

a fire retardant padded frame assembly providing concussive and abrasive protection for the exposed peripheral edges and corners of a raised fireplace hearth having vertical and horizontal walls disposed to enclose said hearth exposed peripheral edges and corner, and opposing outer edges disposed to juxtapose said hearth opposite side walls, said opposing outer edges having a length no greater than the depth of the hearth, and said padded frame assembly having a length between said opposite outer edges no less than the width of the hearth, and tensioning means connectably disposed at said outer edges of the padded frame assembly and displaceable to contact said hearth opposite side walls, whereby, adjusting the tensioning means imparts sufficient tension, directionally imparted from the hearth opposite side walls to the padded frame assembly, to urge the padded frame assembly into a tight gripping relationship with the fireplace hearth.

2. A padding system according to claim 1 wherein the padded frame assembly further comprises:

a pair of end frame assemblies having vertical and horizontal walls disposed to enclose the exposed peripheral edges and corners of said fireplace hearth, and opposing inner and outer edges, said outer edges comprising the outer edges of said padded frame assembly, a center frame assembly having vertical and horizontal walls and first and second edges, having a length between said first and second edges greater than the length between said end frame assembly inner edges, means attaching said center frame assembly to said end frame assemblies, and said attachment means including adjustment means permitting of alteration of the length of said padded frame assembly to accommodate hearths of various widths.

3. The padding system according to claim 1 wherein the tensioning means further comprises a threaded member threadably disposed through said padded frame assembly and having a leading end displaceable from said padded frame assembly outer edge into contact with said hearth outside wall thereby imparting tension to said padded frame assembly sufficient to urge said padded frame assembly into tight gripping relationship to the fireplace hearth.

4. The padding system of claim 1 wherein the padded frame assembly further comprises:

a underlying frame assembly having vertical and horizontal walls disposed to enclose said hearth exposed peripheral edges and corners, and opposing outer edges disposed to juxtapose said hearth opposite side walls, said opposing outer edges having a length no greater than the depth of the hearth, and said frame assembly having a length between said opposite outer edges no less than the width of the hearth, and overlying fire retardant padding means to provide concussive and abrasive protection for the exposed peripheral edges and corners of a raised fireplace hearth overlying said vertical and horizontal walls of the frame assembly, and means to fasten said padding means to said underlying frame assembly.

5. The padding system according to claim 4 wherein said padding means includes angularly disposed pad elements, and releasable fastening means carried by at least one of said frame assembly walls and by said pad elements allowing attached and removal of said padding means from said frame assembly.

6. The padding system according to claim 5 wherein said pad elements further comprise foldable flaps wherein said fastening means are carried by the inner surfaces of at least one of said frame assembly walls and by said padding element foldable flaps, allowing foldable attachment of said padding means to the inner surfaces of said underlying frame assembly walls.

7. The padding system of claim 4 wherein said frame assembly further comprises:

a pair of corner members each having a length no greater than the depth of the hearth, said corner members each having vertical and horizontal walls disposed to enclose a portion of said hearth peripheral edges beginning at a corner formed by said said hearth top surface, front and opposite side walls, a front member assembly having a length no less than the width of the hearth, said front member assembly including a pair of front segments each having horizontal and vertical walls, and opposite inner and outer edges, said outer edges defined by perpendicular end plates, attachments means on said front segments adjacent said inner edges and operable to secure said frame sections together with said outer edges overlying said corner members and juxtaposed said corner member first edges, said attachment means including adjustment means permitting of alteration of the length of said front member assembly to accommodate hearths of various widths, and wherein said tensioning means are connectably disposed at said front segment end plates and displaceable to contact said corner members, said corner members abutting said hearth outer walls, whereby, by adjusting the tensioning means, sufficient tension is imparted from the corner members to the front segments to urge the frame assembly into a tight gripping relationship with the fireplace hearth.

8. The padding system of claim 7 wherein said tensioning means further comprises a threaded member threadably disposed through said front segment end plates and having a leading end displaceable from said front segment end plates into contact with said corner members, said corner members abutting said hearth outer walls, thereby imparting sufficient tension to said frame assembly to urge said frame assembly into tight gripping relationship with the fireplace hearth.

9. The padding system of claim 8 whereby said tensioning means further includes a plurality, comprising at least three, of said threaded members disposed through each of said front segment end plates in a non-linear relationship whereby by varying the displacement of said threaded member leading ends sufficient tension is thereby imparted to urge said frame assembly into tight gripping relationship with a fireplace hearth having irregular dimensions.

10. A padding system for the peripheral edges and corners of a raised fireplace hearth having a top surface bounded by front and opposite side walls, comprising:

a frame assembly having vertical and horizontal walls disposed to enclose said hearth exposed peripheral edges and corners, and opposing outer edges disposed to juxtapose said hearth opposite side walls, said opposing outer edges having a length no greater than the depth of the hearth, and said frame assembly having a length between said opposite outer edges no less than the width of the hearth, fire retardant padding means to provide concussive and abrasive protection for the exposed peripheral edges and corners of a raised fireplace hearth overlying said vertical and horizontal walls of the frame assembly, and tensioning means connectably disposed at said outer edges of the frame assembly and displaceable to contact said hearth opposite side walls, whereby, by adjusting the tensioning means, sufficient tension is imparted, directionally from the hearth opposite side walls to the frame assembly, to urge the frame assembly into a tight gripping relationship with the fireplace hearth.

11. The padding system according to claim 10 wherein said padding means includes angularly disposed pad elements, and releasable fastening means carried by at least one of said frame assembly walls and by said pad elements allowing attachment and removal of said padding means from said frame assembly.

12. The padding system according to claim 11 wherein said pad elements further comprise foldable flaps and wherein said fastening means are carried by the inner surfaces of at least one of said frame assembly walls and by said padding element foldable flaps allowing foldable attachment of said overlying padding means to the inner surfaces of said frame assembly walls.

13. The padding system of claim 10 wherein said frame assembly further comprises:

a pair of corner members each having a length no greater than the depth of the hearth, said corner members each having vertical and horizontal walls disposed to enclose a portion of said hearth peripheral edges beginning at a corner defined by said hearth top surface, front and opposite side walls, a front member assembly having a length no less than the width of the hearth, said front member assembly including a pair of front segments each having horizontal and vertical walls and opposite inner and outer edges said outer edges defined by perpendicular end plates, attachment means on said front segments adjacent said inner edges and operable to secure said frame sections together with said outer edges overlying said corner members and juxtaposed said corner member first edges, said attachment means including alignment means permitting of alteration of the length of said front member assembly to accommodate hearths of various widths, and wherein said tensioning means are connectably disposed at said front segment end plates and displaceable to contact said corner members, said corner members abutting said hearth opposite side walls, whereby, by adjusting the tensioning means, sufficient tension is imparted, directionally from the corner members to the front segments, to urge the frame assembly into a tight gripping relationship with the fireplace hearth.

14. The padding system of claim 13, wherein said tensioning means further comprises a threaded member threadably disposed through said front segment end plates and having a leading end displaceable from said front segment end plates into contact with said corner members, thereby imparting sufficient tension to said frame assembly to urge said frame assembly into tight gripping relationship with the fireplace hearth.

15. The padding system of claim 14 whereby said tensioning means further includes a plurality, comprising at least three, of said threaded members disposed through each of said front segment end plates in a non-linear relationship whereby, by varying the displacement of said threaded member leading ends, sufficient tension is thereby imparted to urge said frame assembly into tight gripping relationship with a fireplace hearth having irregular dimensions.

* * * * *